US009194306B1

(12) United States Patent
Mask et al.

(10) Patent No.: US 9,194,306 B1
(45) Date of Patent: Nov. 24, 2015

(54) HAZARDOUS LOCATION DIESEL ENGINE POWER UNIT WITH PROTECTED CONTROLS FOR AUTOMATIC SHUTDOWN

(75) Inventors: Michael Timothy Mask, Southaven, MS (US); Angelo Jason Morgan, Millington, TN (US); Brandon Scott Isbell, Olive Branch, MS (US)

(73) Assignee: CUMMINS MID-SOUTH, L.L.C., Memphis, TN (US)

( * ) Notice: Subject to any disclaimer, the term of this patent is extended or adjusted under 35 U.S.C. 154(b) by 267 days.

(21) Appl. No.: 13/526,134

(22) Filed: Jun. 18, 2012

Related U.S. Application Data

(60) Provisional application No. 61/498,315, filed on Jun. 17, 2011.

(51) Int. Cl.
*F02D 17/04* (2006.01)
*F02B 77/08* (2006.01)

(52) U.S. Cl.
CPC ..... *F02D 17/04* (2013.01); *F02B 77/08* (2013.01)

(58) Field of Classification Search
CPC ..... F02D 17/04; F02D 41/22; F02B 77/08
USPC ..... 123/198 D, 198 DB, 198 DC, 690, 179.2, 123/179.4; 701/112
See application file for complete search history.

(56) References Cited

U.S. PATENT DOCUMENTS 2,714,290 A 8/1955 Rachuig
3,874,356 A 4/1975 Bacchi
3,886,738 A * 6/1975 Sien ..... 60/277
4,102,316 A 7/1978 Valbert
4,129,040 A * 12/1978 Hayden, Jr. ..... 73/507
4,574,752 A 3/1986 Reichert, Jr. et al.
4,712,372 A * 12/1987 Dickey et al. ..... 60/39.281
5,263,824 A * 11/1993 Waldbeser et al. ..... 417/10
5,422,808 A * 6/1995 Catanese et al. ..... 700/79
5,992,379 A 11/1999 Brudigam et al.
6,276,328 B1 8/2001 Denton et al.
7,072,761 B2 * 7/2006 Hawkins et al. ..... 701/112
7,349,794 B2 3/2008 Malone et al.
7,444,982 B2 * 11/2008 Rivet ..... 123/337

(Continued)

OTHER PUBLICATIONS

Technor Electro Technology Group Catalog, Jan. 2009, Thorne and Derrick UK, pp. 7,8,12,19,20 and 31.*

(Continued)

*Primary Examiner* — Erick Solis
(74) *Attorney, Agent, or Firm* — Wyatt, Tarrant & Combs, LLP; Stephen C. Hall

(57) ABSTRACT

An appropriately constructed and configured internal combustion engine with a control system to safely stop engine operation in the event of a release of flammable gas within the external area surrounding the engine that may consequently enter the engine combustion chamber is provided. The overall device includes an air intake shutoff valve and an externally located remote interface box constructed of a properly rated enclosure material housing necessary sensors and shutoff controls for automatic activation of the air intake shutoff valve. Furthermore, the device includes a separately provided operator control panel for manual override in case of other system failure, including any compromise of the remote interface box controls for any reason. The overall engine and shutdown system, as well as the method of utilizing such a system, are thus encompassed within this invention.

10 Claims, 2 Drawing Sheets

(56) References Cited

U.S. PATENT DOCUMENTS

| | | | | |
|---|---|---|---|---|
| 7,497,195 | B2 * | 3/2009 | Umezu et al. | 123/179.4 |
| 7,877,193 | B2 | 1/2011 | Rall et al. | |
| 8,662,055 | B2 * | 3/2014 | Kabrich et al. | 123/397 |
| 2004/0118374 | A1 * | 6/2004 | Bedwell et al. | 123/198 D |
| 2006/0015244 | A1 * | 1/2006 | Hawkins et al. | 701/112 |
| 2007/0093954 | A1 | 4/2007 | Malone et al. | |

OTHER PUBLICATIONS

Weidmuller, Hazard Areas Technical Guide, "An Introduction to ATEX Terminology and Regulations", Weidmuller, Jan. 2011, pp. 14, 24, 40, 42, 43, 63-65.*

* cited by examiner

HAZARDOUS LOCATION DIESEL ENGINE POWER UNIT WITH PROTECTED CONTROLS FOR AUTOMATIC SHUTDOWN

REFERENCE TO CORRELATED APPLICATIONS

This application is the conversion of and claims the benefit of U.S. Provisional Patent Application 61/498,315, filed on Jun. 17, 2011. Such prior patent application is herein incorporated in its entirety.

FIELD OF THE INVENTION

The present invention relates to an appropriately constructed and configured internal combustion engine with a control system to safely stop engine operation in the event of a release of flammable gas within the external area surrounding the engine that may consequently enter the engine combustion chamber. The overall device includes an air intake shutoff valve and an externally located remote interface box constructed of a properly rated enclosure material housing necessary sensors and shutoff controls for automatic activation of the air intake shutoff valve. Such an externally located box is connected to the engine through appropriately protective cables to best ensure continued viability of the automatic shutdown mechanisms to prevent undesired continued operation of the combustion chamber in the event of a flammable material breach therein. Furthermore, the device includes a separately provided operator control panel for manual override in case of other system failure, including any compromise of the remote interface box controls for any reason. The overall engine and shutdown system, as well as the method of utilizing such a system, are thus encompassed within this invention.

BACKGROUND OF THE INVENTION

Internal combustion engines have been utilized since their advent for myriad applications, particularly to generate power (such as, as one example, electricity) through the combustion of certain fuels. The ability to ignite combustible materials within an enclosed system allows for transfer of such energy to a proper power transfer device (such as a dynamo, for instance) in order to allow for electricity supplies at remote or mobile locations. Such devices thus include a suitable air intake component to properly combine oxygen within the combustion chamber for proper ignition.

Although many internal combustion engines are utilized in relatively "safe" locations (such as within automobiles or at construction sites), other locations have proven rather risky for the presence and utilization of such devices due to the delicate nature of the site or the environmental conditions themselves. For instance, mining operations require electricity (and possibly other sources of power generation) but may be subject to potentially hazardous environmental conditions if flammable gases or other explosive compounds are released in the vicinity of such an engine. As another example, oil rigs require a great amount of electricity (or other power sources) to run the drilling machines and other mechanical devices, but any explosive potential may cause very dangerous results. The improper running or undesired introduction of flammable fuels upon shutdown within an internal combustion engine could have terrible consequences in such a delicate environment. There are certainly many other instances of such hazardous possibilities with internal combustion engines present, as well.

As a result, certification of such combustion equipment is required for such types of locations. In particular, in areas where a potential release of flammable gas or vapor may occur, industrial standards have been set to concern the level of risk for exposure to such conditions. For example, such hazardous environment applications may be categorized as Group I Division 2, a label set within the National Electrical Code (NEC) Article 500.5 (B)(2) as a location in which flammable gases or vapors are normally confined within enclosed containers or closed systems from which they can escape only in case of accidental breakdown of processes or equipment. Such a definition is rather easily met by a engine including totally mechanical parts as no sparks or combustible fuels would cause such problems. However, with electrical systems, such a standard provides a heightened degree of caution in order to best limit further destructive consequences through such a potential introduction of hazardous flammable liquids within such an electrically controlled combustion chamber. The provision of an appropriately protective and presumably flammable liquid preventive electricity generating internal combustion engine is thus required by regulatory agencies.

In essence, then, past hazardous environment applications required, at a minimum, a redundant engine shutdown system (as well as a primary standard engine shutdown system) in order to thwart any appreciable potential for flammable liquid or vapor introduction within such an internal combustion engine during standard use. Past redundant engine shutdown systems have been rather limited in their overall capability, however, particularly due to the general potential for monitoring for certain excessive or low readings through internal sensors. If such measurements meet certain parameters, then the shutdown system becomes activated, effectively turning off the overall device. Such a shutdown, however, does not control the combustion chamber itself, and merely allows for the shutdown of power to the overall engine. The continued combustion chamber operation (in one such instance, at least) may still lead to undesirable flammable liquid introduction therein, thus compromising, potentially, not only the usefulness of the subject internal combustion engine in total, but the safety of the entire surrounding area as the hazardous environment requirements, noted above, would be breached if the combustion chamber itself remained in operable and running condition. Serious, if not total, damage to the subject engine or surrounding devices, machines, and/or instruments, may thus occur subsequent to actual engine shutdown. Avoiding such consequential and potentially significant problems, both technically and financially, is thus of great importance to the industry.

The pertinent prior art does provide certain systems for possible engine shutdown, but with limited utility in terms of sensor usage and correlated shutdown potential. There is no teaching nor fair suggestion within the pertinent industrial area of an engine that utilizes not only a multi-operable sensor system, but also provides explosion protection to an externally located control panel, as well as a manual override in case the situation and/or environment dictates operator involvement. The limited redundant shutdown systems in the prior art (such as within U.S. Pat. No. 7,072,761 to Hawkins et al.) fail to take into account the further necessities of air intake shutdown valve usage, nor the removal of a control box from the surface of the subject internal combustion engine itself.

Without any such protections in place, it is difficult to fathom the possible utilization of such engines in Class I locations without first being subject to high scrutiny by a private regulatory compliance organization (such as Underwriters Laboratories, for instance). Thus, the ability to undertake a properly designed internal combustion engine system within such a designated hazardous location with reliable components to compensate for any and all potential safety breaches that fall within the Class I Division II category would be of great importance. Unfortunately, to date, there have been no such internal combustion engine devices that meet such stringent requirements, particularly including all of the above-described components. Although some devices have been provided commercially that incorporate individual components (such as an intake shutoff, or perhaps an auxiliary spark preventing muffler), no devices including multiple protective measures of these types have yet to be accorded the power generation industry, specifically in terms of developing an engine that meets certain rigid standards for, as one example, Underwriter Laboratories acceptance for certain potentially hazardous locations.

ADVANTAGES AND SUMMARY OF THE INVENTION

One distinct advantage of the present invention is the provision of an entire engine system that accords multiple levels of shutdown control from automatic air intake shutdown to sensor usage to monitor vital operation levels to manual shutdown if all else fails as expected. Another advantage of this inventive device is the inclusion of a remotely located, though connected, engine control module housed within an explosion-proof enclosure. Yet another advantage is the ability to meet stringent regulatory requirements, and thus passage of UL codes and tests, without any subsequent analysis and testing after installation at a specific location. Furthermore, this invention advantageously permits effective shutdown control subsequent to engine failure and explosion through on-site or remote switches that can withstand such failure and explosion events.

Accordingly, the inventive internal combustion engine encompasses a device including an air intake with a shutdown valve integrated therein, wherein said valve is activated upon the occurrence of at least of a number of possible events, said events including exceeding of 115% of operable engine speed as well as selected shutdown through manual operation at a location remote from the engine itself, said engine further comprising an engine control module housed within an explosion-proof enclosure and situated at a location remote from said engine itself, wherein said engine control module is connected to said engine through at least one cable rated for connection to explosion rated devices, and wherein said engine further includes a remote operator control panel including an overall activation switch and manual inactivation switch, wherein said operator control panel is connected to said engine either directly or through said engine control module via at least one properly configured cable of at least the same rating as for the engine control module connection between said engine control module and said engine. A method of monitoring and potentially shutting down such an engine upon a destructive event occurrence is also encompassed within this invention. In particular, a method of monitoring and potentially shutting down an internal combustion engine upon a destructive event occurrence, wherein said engine comprises an engine control module housed within a properly rated explosion-protection enclosure and situated at a location remote to said engine, wherein said engine control module is connected to said engine through at least one cable rated for proper connection to said explosion-protected enclosure housing said engine control module itself, and wherein said engine further includes a remote operator control panel including a manual switch for overall activation and/or inactivation of said engine, wherein said remote operator control panel is connected to said engine either directly or through said engine control module through at least one properly configured cable meeting at least the same protection levels as the cable connecting said engine control module to said engine; wherein said method includes activation of said switch on said remote operator control panel manually subsequent to a destructive occurrence event, wherein neither of said engine control module nor said properly rated cable connecting said control module to said engines has been damaged to such a degree as to prevent inactivation and/or shutdown of said engine through said remote operator control panel.

The engine itself may be of any typical internal combustion configuration and thus includes an ignition chamber that incorporates temperature, pressure, and air introduction to produce the necessary fuel combustion result to ultimately cause movement of another incorporated device that generates electrical charges that can then be collected and transported for utilization at a selected nearby location. The important requirements of the inventive system include the incorporation of the particular shutdown mechanisms with the specific construction limitations noted above. To that end, the utilization of a monitoring system with automatic activation of an air intake shutdown valve if the engine runs at too high an operating level (which would indicate the high potential for engine failure to the degree that continued operation would compromise the integrity of the overall engine system without such a shutdown protocol in place), coupled with a connected, but remotely located engine control module within an explosion-protective housing and including further sensors and devices that monitor other engine parameters for possible engine failure potential and thus automatic engine shutdown capability, has yet to be provided within the internal combustion engine industry. The air intake shutdown valve allows for the prevention of needed air from entering the combustion chamber. Without any air, the combustion process cannot proceed, thus effectively stopping any combustion to any degree. Thus, upon valve activation, even upon the discontinuation of flammable fuel supplies within the engine system (through, for instance, automatic or manual shutoff through the engine control module sensing system or through operator activity), any possible external flammable fuel sources from the vicinity of the engine (e.g., the Class I Division II hazardous site) would not experience combustion within the engine.

The overall effect available within such an all-encompassing combustion shutdown procedure accords the user the highest degree of reliability that a potentially dangerous flammable liquid combustion event would not occur upon the possible failure of the engine itself. Such a result is further accorded the user with an internal combustion engine that functions at as efficient a level as expected and without any compromise in such capabilities, thus assuring the user that the necessary level of electricity generation is sufficiently high to make the engine itself cost-effective (for instance, the amount of Diesel fuel needed to generate a certain amount of electricity, ultimately, is no more than that typically associated with such devices).

Thus, the modifications undertaken for the inventive engine device are of great importance to provide the reliable shutdown potential if engine failure is imminent (or actually occurs). The combination of individual components, particularly with such devices provided at a location remote, though still attached, from the subject engine itself, and with each remote component encased within appropriately rated protective materials to best ensure any deleterious events (such as explosions from or near the subject engine) will not compromise the remote enclosures, and thus the device housed therein, has never been provided in the internal combustion engine industry to the level of acceptance for Class I hazardous locations. As such, the shutdown reliability potential accorded the user with these changes is unexpectedly high through the inventive system. In particular, previous engine control modules have been situated on the engines themselves and provided in a standard configuration and construction that did not take into account any possible issues that an unexpected explosion or other like event could destroy the module or at least compromise the electronic sensors, etc., housed therein. The inventive engine system has taken a completely new approach through the placement of such an engine control module at a location remote from the engine itself, but still housed in an explosion-proof enclosure, in order to best ensure that the electronics, etc., within the module are not subject to destruction during an engine failure event.

As well, the continued viability of the controls within the module even upon the possible failure of the engine, allows for continued control over the engine operations such that the shutdown of the entire engine (or any portion thereof, including, for instance, the air intake shutoff valve, particularly if such a valve is not activated on its own prior to engine failure) may still occur instantaneously and reliably, if necessary. The engine control module, in effect, houses sensors and shutdown controls that measure and notify and/or shutdown engine operations in relation to a variety of engine parameters, including temperature levels (too high and the system may be compromised), oil pressure, fuel introduction rate, and the like. The shutdown controls may apply to any number of engine components in order to reliably prevent further engine operations upon a monitored engine failure event occurs. Thus, for instance, the module may communicate with the fuel pump to stop transfer of fuel into the combustion chamber, or with the air intake shutdown valve to activate, as examples. Overall, the total effect of such combined shutdown capabilities is the discontinuation of engine operations thus reducing potential unwanted combustion activity on one hand and possibly further internal engine activity that may cause destructive results that would require complete engine overhaul, if not replacement. With the reliable shutdown capabilities integrated as provided within the inventive system, such undesirable consequences may be avoided to a high degree.

Even with the automatic air intake shutdown potential and the engine control module located safely in a remote, yet viable, location, in relation to the subject internal combustion engine, there still remains a potential that the overall system may not discontinue operations if engine parameters are compromised. Thus, in addition to these initial shutdown capabilities, the overall system includes a manual shutdown component as well, connected to the engine control module through at least one suitable cable. Such a remote operator control may also include the general engine switches to start and stop, as well as readouts to monitor the engine parameters themselves during use.

The connections between the engine control module (ECM) and the engine itself, as well as the engine control module and the remote operator control are through appropriately configured and supplied wires that effectively transfer electrical signals for control purposes. Such wires are housed, importantly, within properly rated cables that accord, as with the engine control module itself, protection to the needed wires and configurations therein in order to prevent any compromise of the signal transfer capability during an engine failure. A properly rated marine cable, for instance, provides the necessary degree of high protection to that effect, for both of the connections at issue. Basically, then, the ECM provides full engine control functions including the software for engine shutdown. The remote operator control provides control functions through hardware and discrete inputs such as start, stop, and operating the overall system and device and is housed within a properly structured enclosure (NEMA 4, at least), similar to that within which the ECM is present. Such a remote operator control thus permits manual control of the system if needed and at a safe location to prevent injury to the operator.

As alluded to above, the ECM may monitor a wide variety of sensors or other indicators to determine if a sensor or indicator indicates that the engine parameter is above a threshold level. Examples of sensors that are directly related to the engine operation that may be monitored include engine coolant temperature sensors, oil temperature sensors, exhaust temperature sensors, oil pressure sensors, turbo-charger compressor outlet temperature sensor, coolant level monitor, engine oil level monitor, engine RPM tachometer, and intercooler temperature. The control system may also monitor sensors that are not associated with the engine. Examples of external sensors include environmental gas detection sensors for sensing the presence of potentially dangerous gasses in the air around the engine and transmission temperature monitors.

In such a configuration, the sensors of the interface box measure certain specific parameters and automatically activate the air intake shutoff valve if certain levels are exceeded, thus preventing any combustion potential even if flammable liquid enters the combustion chamber. As well, the manual override allows for such shutdown mechanisms if the electronics fail to perform the necessary operations.

The ECM or remote operator control may shut down the engine in various ways including shutting off fuel supply, air supply, or electronic control signals. Either system may also be used to trigger an external shutdown system such as a Halon injection system or an air shut off valve. If sensors indicate a deviation from the acceptable level and the ECM fails to shut down the engine, the remote operator control may activate an alarm to alert the user of the need for shutdown in case the ECM fails to provide the necessary discontinuation of engine operations.

The term "explosion-proof" or "explosion-protective" or any other like phrase indicating similar characteristics, is intended to primarily encompass a material or enclosure that prevents an external explosion (or like event) from penetrating such a material or enclosure to the extent that machinery or electronics, or other potentially delicate materials, will not be appreciably harmed thereby. As well, however, such a descriptor may also be considered as preventing rupture of such materials or enclosures from an internal event of like magnitude.

These and other aspects of the invention will become apparent in view of the attached drawings and detailed description of a preferred embodiment of the invention.

DETAILED DESCRIPTION OF THE DRAWINGS AND PREFERRED EMBODIMENTS

Without any intention of limiting the scope of the overall invention, the drawings described herein are in relation to potentially preferred embodiments. The ordinarily skilled artisan would understand the breadth of the overall inventive device in view of the descriptions and explanations herein.

Figure 1:
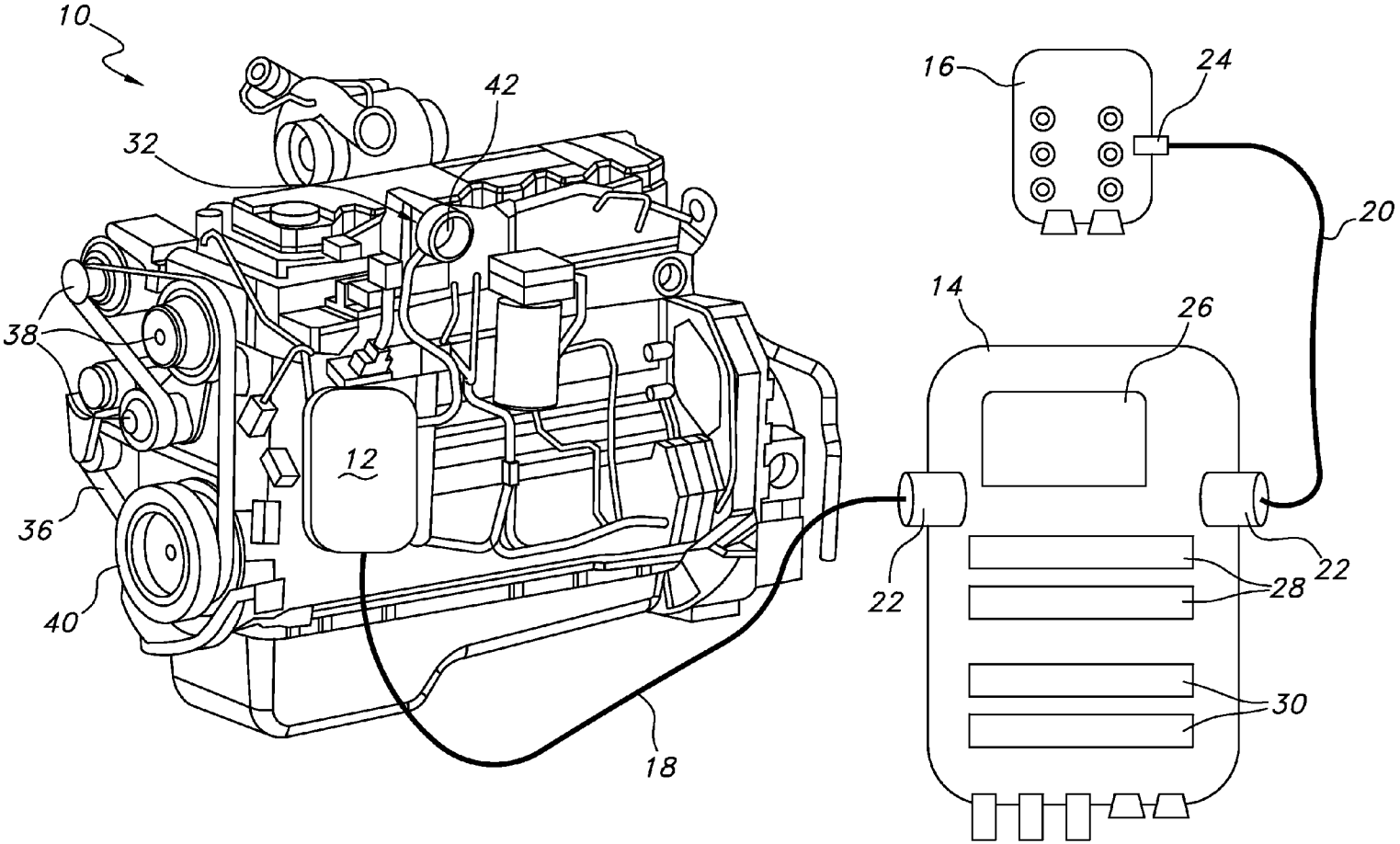
FIG. 1 is an isometric view of an inventive internal combustion engine including the remote ECM and operator controls.
Figure 2:
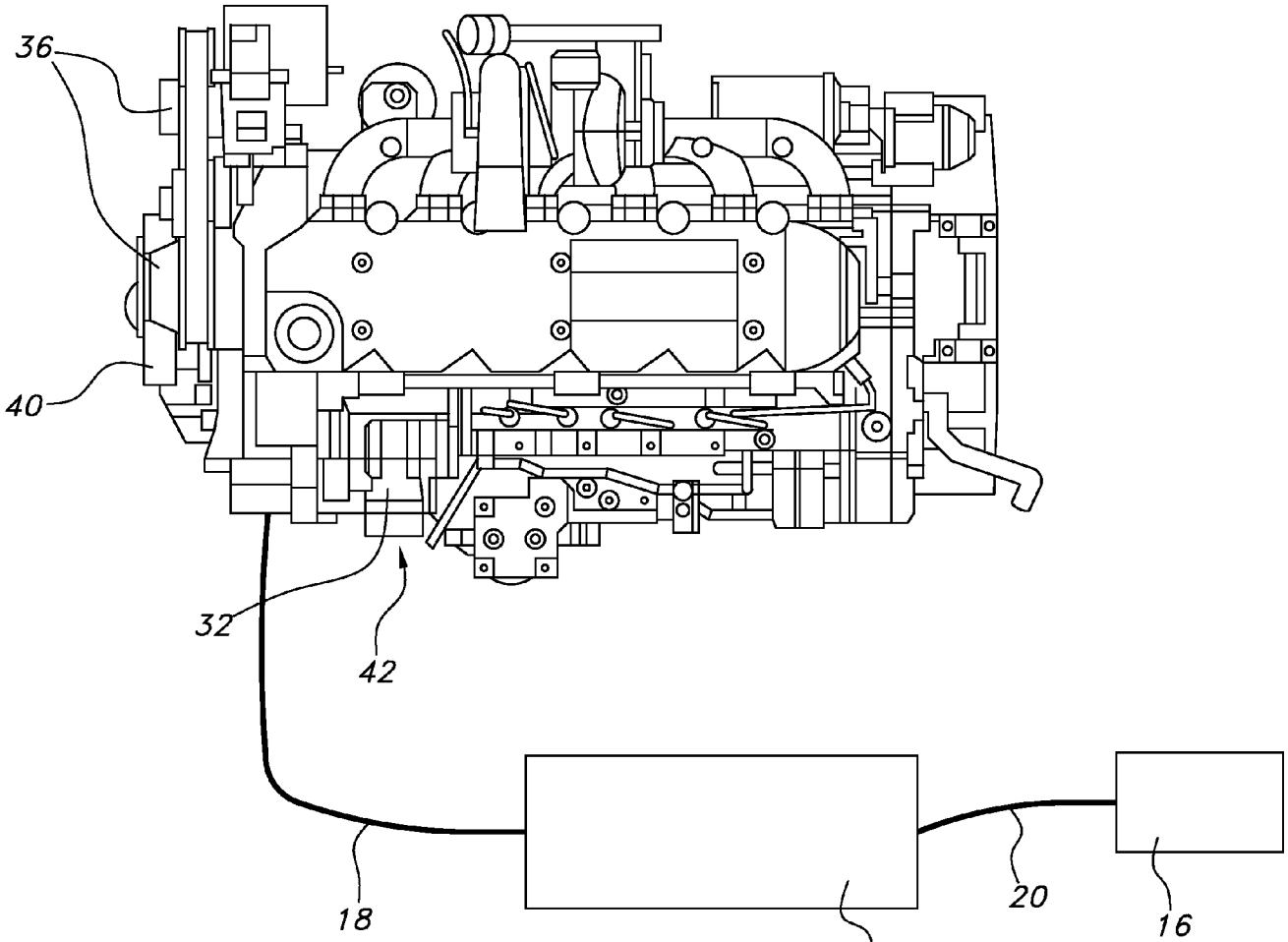
FIG. 2 is an aerial view of the same inventive engine of FIG. 1.

Referring now to FIGS. 1 and 2, an engine 10 is shown including an internal combustion chamber (not illustrated) that drives pistons (not illustrated) connected to rotors 38 that turn while the engine 10 is running. In turn, a rubber belt 36 controls a further rotor 40 that includes an internal dynamo 40 for electrical charge generation. An air intake 32 is connected to the combustion chamber to permit sufficient air therein for combustion to occur as directed by a user. At the outer portion of the air intake 32 is an air intake shutoff valve 42 that includes a sensor and activating control unit (not illustrated) that monitors the running speed of the engine 10 itself; if the speed exceeds 115% of its rated level, the air intake shutoff valve 42 is activated and the ability of the air intake 32 to transfer sufficient air for continued combustion to occur within the subject chamber is prevented. As one line of defense to improper operation of the engine 10, at least to the degree that total engine failure may occur within the vicinity of a Class I Division II location, such a shutoff capability creates a safe and reliable result to that degree.

Additionally, as discussed above, the overall engine 10 includes a protectable interface box (enclosure) 14 that houses a variety of controls for operation of the engine 10 at a remote location. The box 14 includes the engine control module (ECM) 26, as well as electrical relays 28 and other electrical components 30 that monitor and control the electrical activation capabilities of the engine 10. Such control is permitted through a terminal strip box 12 present on the engine 10 and connected thereto in a manner to provide the needed electrical signals to allow for direct controls and sensors to the appropriate components within and on the engine 10. The terminal strip box 12 (rated for Class 1 Div 2 use and as a NEMA 4 enclosure) and the interface box 14 (explosion-rated) are both constructed from proper protective materials (explosion-proof, as described herein, for example) in order to ensure proper control of such engine components is not compromised during an engine failure or other type event. The two boxes 12, 14 are connected to one another through a properly rated cable 18 that may withstand any such engine failure event as well. A proper plug device 22 is connected to such a cable 18 and attached, permanently or removably from the interface box 14 to, again, ensure proper signal transfer is not compromised in the event of a catastrophic occurrence. The same type of plug 22 is utilized on the interface box 14 to attach to a further high-rated cable 20 to allow for signal transfer to an operator control panel 16, too. A like plug 24 is attached to the panel 16 to complete the chain of signal transfer potential between the panel 16 and the terminal strip 12 on the surface of the target engine 10. The operator control panel 16 includes controls for start and stop, as well as other monitoring capabilities for the user to view the overall conditions of the target engine 10 from a safe distance. If there is a possible engine failure that has not been responded to through air intake shutoff or automatic shutdown through the interface box 14 components (such as through high temperature sensors not overriding the engine operations and shutting down everything, including activating the air intake shutoff valve, for instance), then the user may, from a remote location, utilize the operator control panel 16 for such a purpose.

In greater detail, as noted above, the ECM 26 is programmed to shut down the engine in certain circumstances. Again, the ECM 26 is kept at a location remote from the engine 10 and within an interface box enclosure 14 made from explosion-proof materials (such as cast aluminum or steel). The engine 10 includes a variety of sensors (not illustrated) that detect specified engine operating conditions, including, for instance, a coolant temperature sensor, an oil temperature sensor, an exhaust temperature sensor, an oil pressure sensor, a coolant level sensor, an oil level sensor, a tachometer, and others. As noted above, the tachometer sensor is not only connected to the ECM 26, but also the air intake shutoff valve 42, to permit engine shutdown if the rated speed exceeds a maximum threshold of 115% standard measure. In case the shutoff valve 42 does not operate properly upon exceeding such a threshold level, the ECM may then activate an engine shutdown operation itself. Otherwise, the threshold parameters for such other measurements are constantly monitored and if any become exceeded during operation, the ECM may then cause the necessary engine shutdown, including its own control, possibly of the air intake shutoff valve 42, as well as a possible air injection system that injects an inert gas into the engine to effectuate combustion prevention and thus engine shutdown.

In addition to the above sensors, other external sensors (not illustrated nor associated directly with the engine 10) may be provided that are monitored by the ECM 26 for engine shut down conditions, including a sensor to alert to the presence of an external hazardous flammable liquid presence, as one example.

As alluded to above, too, an alarm may be included within the operator control panel 16 to alert the user to any sensor problems or threshold excesses noted by the ECM that may require operator attention.

The overall device thus allows for complete engine shutdown in case of a failure event, thus preventing any further flammable liquid entry and/or combustion within the chamber as well as any possible unwarranted and irreparable damage to the engine 10 due to further operation subsequent to engine failure. The capability of instantaneous shutdown through one of three different controls provides a more reliable mechanism for the user to permit a safe location for efficient and effective internal combustion engine utilization, even within an area designated as Class I Division II in terms of hazardous materials and/or flammable liquid potential presence. Such a benefit, particularly with the provision of highly protective enclosure materials and cables to ensure continued remote control potential during an engine failure event, is highly unexpected and important as now a reliable combustion engine may be provided for such potentially hazardous locations without high threshold regulatory concerns to be met.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

We claim:

1. An internal combustion engine encompassing an air intake with a shutdown valve integrated therein, wherein said valve may be activated automatically or manually; said engine further comprising an engine control module housed within an explosion-proof enclosure and situated at a location remote to said engine, wherein said engine control module is connected to said engine through at least one explosion-proof cable, and wherein said engine further includes a remote operator control panel including a manual switch for overall activation and/or inactivation of said engine, wherein said remote operator control panel is connected to said engine control module through at least one explosion-proof cable meeting at least the same protection levels as the cable connecting said engine control module to said engine.

2. The engine of claim 1 wherein said shutdown valve may be activated automatically if the operation of said engine exceeds 115% of operable engine speed.

3. The engine of claim 1 wherein said engine further includes sensors to monitor one or more of the following: engine temperature, oil pressure, and fuel introduction rate.

4. The engine of claim 2 wherein said engine further includes sensors to monitor one or more of the following: engine temperature, oil pressure, and fuel introduction rate.

5. A method of monitoring and potentially shutting down an internal combustion engine upon a destructive event occurrence, wherein said engine comprises an engine control module housed within an explosion proof enclosure and situated at a location remote to said engine, wherein said engine control module is connected to said engine through at least one explosion-proof cable, and wherein said engine further includes a remote operator control panel including a manual switch for overall activation and/or inactivation of said engine, wherein said remote operator control panel is connected to said engine control module through at least one explosion-proof cable meeting at least the same protection levels as the cable connecting said engine control module to said engine; wherein said method includes activation of said switch on said remote operator control panel manually subsequent to a destructive occurrence event, wherein neither of said engine control module nor said at least one cable connecting said control module to said engines has been damaged to such a degree as to prevent inactivation and/or shutdown of said engine through said remote operator control panel.

6. The method of claim 5 wherein said engine control module is connected to an explosion-proof terminal strip box mounted on an connected directly to said engine, wherein said engine control module is connected to said terminal strip box through at least one explosion-proof cable.

7. An internal combustion engine encompassing an air intake with a shutdown valve integrated therein, wherein said valve may be activated automatically or manually; said engine further comprising an engine control module housed within a an explosion-proof enclosure and situated at a location remote to said engine, wherein said engine control module is connected to an explosion-proof terminal strip box mounted on and connected directly to said engine, wherein said engine control module is connected to said terminal strip box through at least one explosion-proof cable, and wherein said engine further includes a remote operator control panel including a manual switch for overall activation and/or inactivation of said engine, wherein said remote operator control panel is connected to said engine control module through at least one explosion-proof cable meeting at least the same protection levels as the cable connecting said engine control module to said engine.

8. The engine of claim 7 wherein said shutdown valve may be activated automatically if the operation of said engine exceeds 115% of operable engine speed.

9. The engine of claim 7 wherein said engine further includes sensors to monitor one or more of the following: engine temperature, oil pressure, and fuel introduction rate.

10. The engine of claim 8 wherein said engine further includes sensors to monitor one or more of the following: engine temperature, oil pressure, and fuel introduction rate.

* * * * *